US007234991B2

(12) United States Patent
Lo et al.

(10) Patent No.: US 7,234,991 B2
(45) Date of Patent: Jun. 26, 2007

(54) MOVING TOY

(75) Inventors: Kai Chai Lo, Hong Kong (HK); Chi Yui Lau, Hong Kong (HK)

(73) Assignee: Firecode Ltd., Kowloon (HK)

( * ) Notice: Subject to any disclaimer, the term of this patent is extended or adjusted under 35 U.S.C. 154(b) by 170 days.

(21) Appl. No.: 10/843,288

(22) Filed: May 10, 2004

(65) Prior Publication Data

US 2005/0250413 A1 Nov. 10, 2005

(51) Int. Cl.
*A63H 17/00* (2006.01)
*A63H 17/42* (2006.01)

(52) U.S. Cl. ..... 446/441; 446/462; 446/465

(58) Field of Classification Search ..... 180/277, 180/279; 446/436, 441, 462, 465, 468
See application file for complete search history.

(56) References Cited

U.S. PATENT DOCUMENTS

| | | | | |
|---|---|---|---|---|
| 3,391,669 | A * | 7/1968 | Buster | 340/288 |
| 4,058,182 | A * | 11/1977 | Huber | 180/274 |
| 4,194,588 | A * | 3/1980 | Wygal et al. | 180/279 |
| 4,591,347 | A * | 5/1986 | Goldfarb et al. | 446/462 |
| 5,230,543 | A * | 7/1993 | Douglas et al. | 293/2 |
| 5,238,083 | A * | 8/1993 | Horie et al. | 180/274 |
| 5,703,450 | A * | 12/1997 | Josephs | 318/379 |
| 5,816,358 | A * | 10/1998 | Adler et al. | 180/279 |
| 6,243,632 | B1 * | 6/2001 | Jung | 701/45 |
| 6,371,830 | B1 * | 4/2002 | Wu et al. | 446/457 |
| 6,771,034 | B2 * | 8/2004 | Reile et al. | 318/139 |
| 2002/0142701 | A1 * | 10/2002 | Rosenberg | 446/454 |

FOREIGN PATENT DOCUMENTS

| | | | |
|---|---|---|---|
| EP | 505377 | A1 * | 9/1992 |
| FR | 2594256 | A * | 8/1987 |
| FR | 2625957 | A * | 7/1989 |
| FR | 2669866 | A1 * | 6/1992 |
| JP | 01178034 | A * | 7/1989 |
| JP | 2000072007 | A * | 3/2000 |
| WO | WO 9529076 | A1 * | 11/1995 |

* cited by examiner

*Primary Examiner*—John A. Ricci
(74) *Attorney, Agent, or Firm*—Blakely, Sokoloff, Taylor & Zafman; Stephen M. De Klerk

(57) ABSTRACT

A moving toy, e.g. toy car, comprises a body, wheels for moving the body on a surface, and an electric motor provided in the body for driving the wheels. A control circuit is connected to the motor for controlling the performance of the motor. Also included one or more impact detectors connected to the control circuit for detecting an impact acted upon the toy and in response providing a signal to cause the control circuit to reduce the performance of the motor and hence the speed of the car.

6 Claims, 4 Drawing Sheets

MOVING TOY

The present invention relates to moving toys, such as toy cars, for playing a combatant game.

BACKGROUND OF THE INVENTION

Toy cars in a combatant game usually compete for speed. Battle games for toy cars, especially those in which the cars are controlled to move and hit each other like in a boxing game, are not common but can be fun.

The invention seeks to provide a moving toy that can be played for this or similar purpose.

SUMMARY OF THE INVENTION

According to the invention, there is provided a moving toy comprising a body, rotary means for moving the body on a surface, and an electric motor provided in the body for driving the rotary means. A control circuit is connected to the motor for controlling the performance of the motor. Also included is at least one impact detector connected to the control circuit for detecting an impact acted upon the toy and in response providing a signal to cause the control circuit to reduce the performance of the motor.

Preferably, said at least one impact detector is provided at a specific position of the toy for detecting an impact acted upon the toy in the region of that position.

More preferably, the moving toy includes a plurality of said impact detectors provided at different positions of the toy, each for detecting an impact acted upon the toy in the region of the corresponding position, and a visual indicator provided at or adjacent each of at least some of the positions for indicating detection of an impact in that region.

It is preferred that the moving toy includes a plurality of said impact detectors provided at different positions of the toy, each for detecting an impact acted upon the toy in the region of the corresponding position, for providing corresponding signals causing the control circuit to progressively reduce the performance of the motor.

In a preferred embodiment, said at least one impact detector is adapted to provide a plurality of said signals upon successive impacts acted upon the toy, the signals causing the control circuit to progressively reduce the performance of the motor.

More preferably, the moving toy includes a plurality of said impact detectors provided at different positions of the toy, each for detecting an impact acted upon the toy in the region of the corresponding position to provide a respective said signal.

It is preferred that said at least one impact detector comprises an electrical switch associated with a receiver for receiving an impact.

It is further preferred that the receiver is resiliently biassed outwards.

In a preferred construction, the rotary means comprise a plurality of wheels, and said at least one impact detector is provided at one of the wheels.

More preferably, said at least one impact detector comprises an electrical switch associated with a receiver for receiving an impact, the receiver being located partially in the wheel and resiliently biassed outwards therefrom.

Further more preferably, the receiver includes a shaft extending rearwardly therefrom and having a rear end immediately behind which the switch is located.

Alternatively, said at least one impact detector is provided at a rear end of the body.

It is preferred that the control circuit is adapted to reduce the performance of the motor by taking one of the actions comprising slowing down the motor and stopping the motor.

BRIEF DESCRIPTION OF DRAWINGS

The invention will now be more particularly described, by way of example only, with reference to the accompanying drawings, in which.

DETAILED DESCRIPTION OF BEST MODE EMBODIMENT

Figure 1:
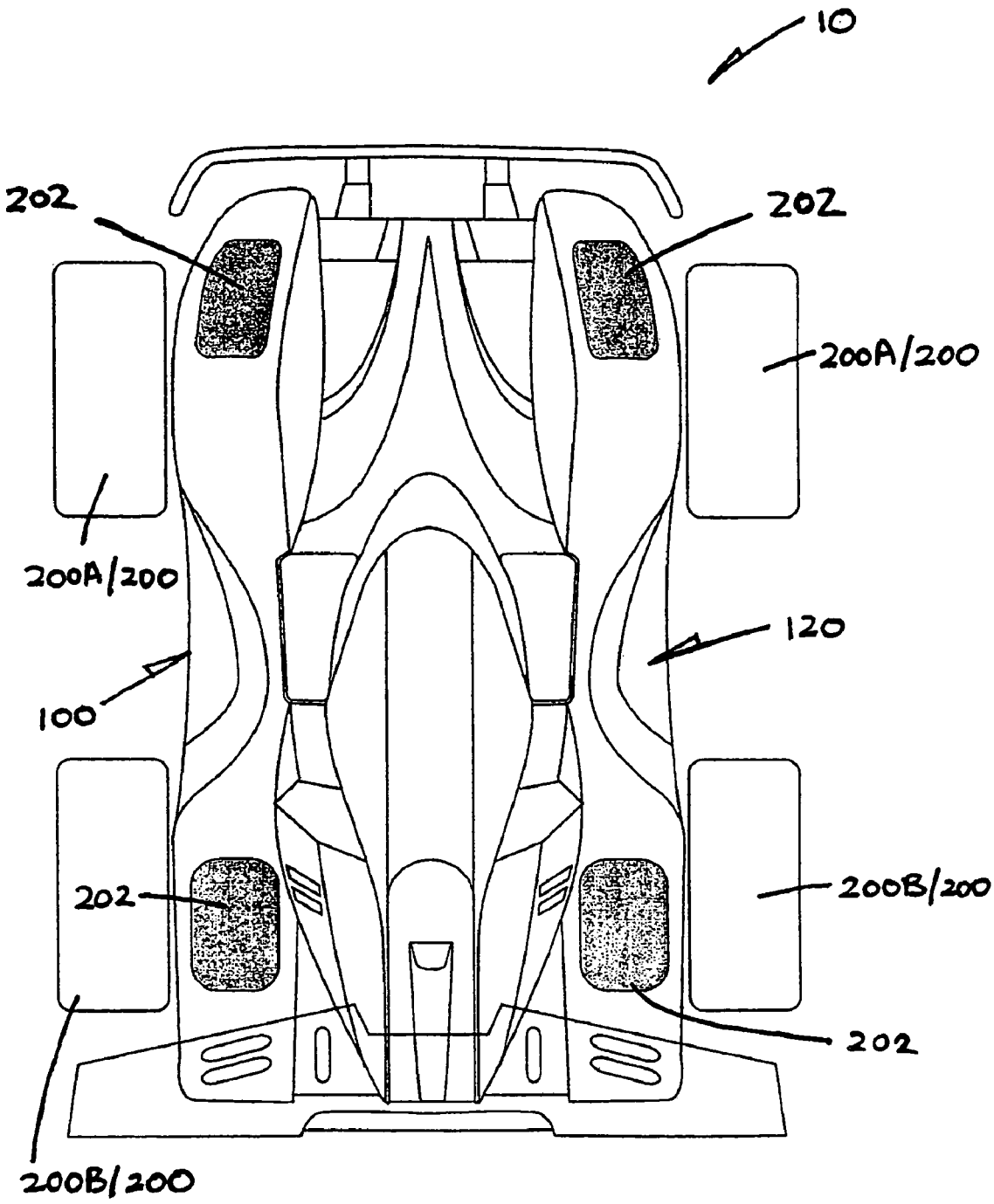
FIG. 1 is a top plan view of an embodiment of a moving toy in accordance with the invention.
Figure 2:
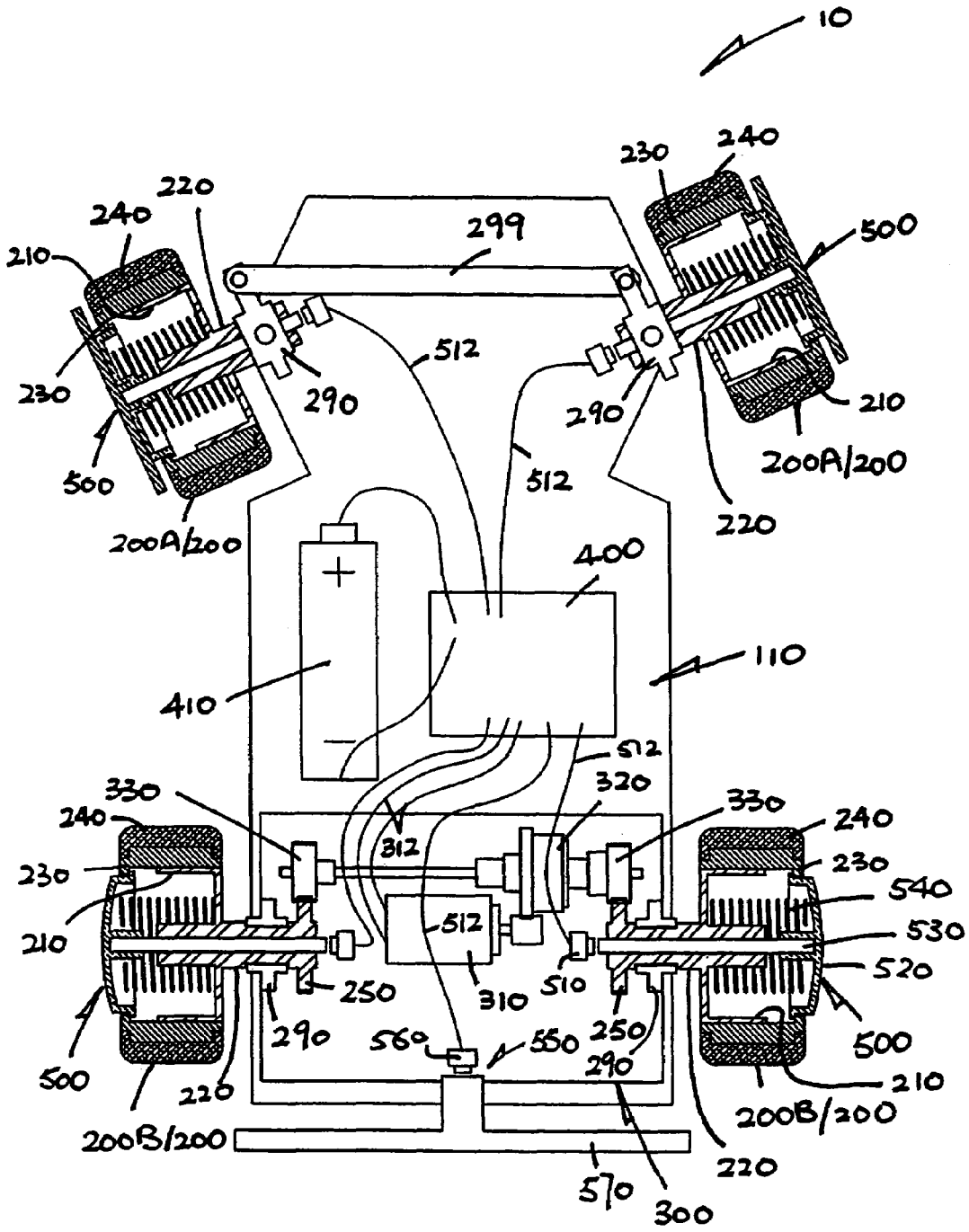
FIG. 2 is a top plan view of a base part of the moving toy of FIG. 1, including four wheels.
Figure 3:
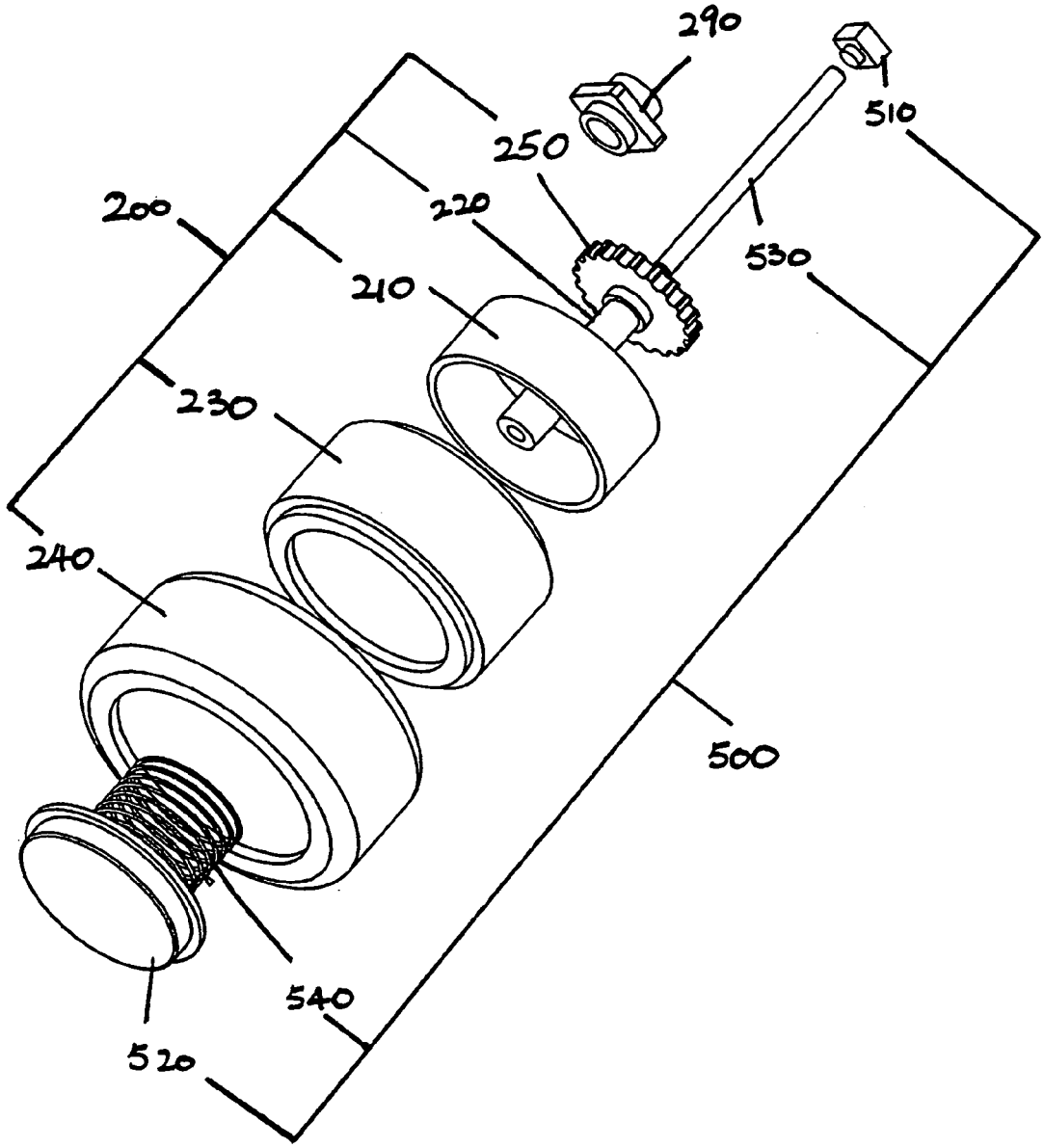
FIG. 3 is an exploded perspective view of one of the wheels of FIG. 2.
Figure 4A:
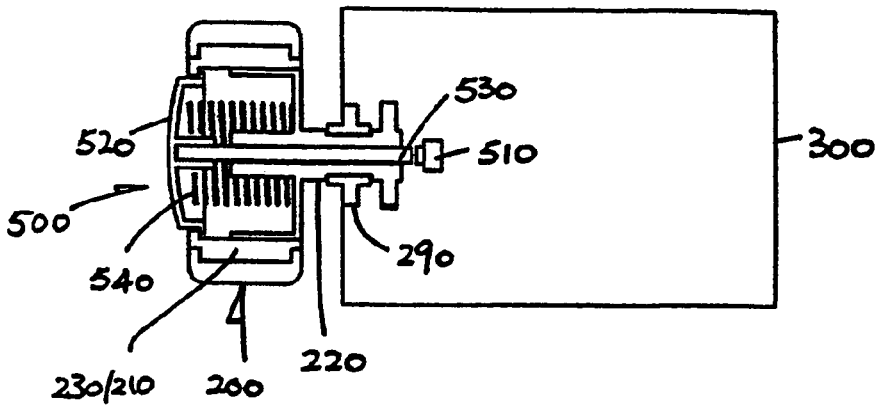
FIGS. 4A and 4B are similar cross-sectional views of the wheel of FIG. 3, showing it in different conditions.
Figure 4B:
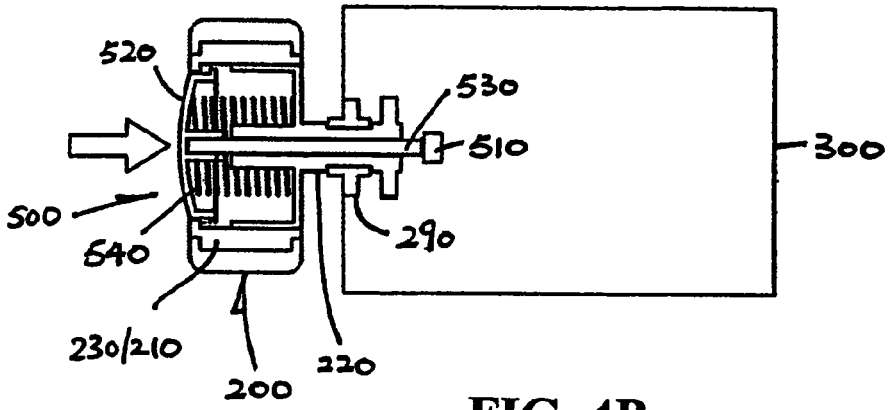

Referring initially to FIGS. 1 to 4B of the drawings, there is shown a moving toy in the form of a toy car 10 embodying the invention, for playing in a battle game with another car or cars, in which the cars are controlled to move about to hit and/or avoid hitting by the opponent car(s). The car 10 has a body 100 and two pairs of front and rear wheels 200A and 200B or collectively 200. The body 100 includes a chassis 110 to which the wheels 200 are attached, and a housing 120 fixed on the chassis 110. Mounted internally on the chassis 110 are a drive unit 300 for driving the rear wheels 200B and an electronic control circuit 400 powered by a battery cell 410 for controlling the operation and performance of the drive unit 300.

Each wheel 200 has an inner rim 210 from which a tubular central shaft 220 extends rearwardly, an outer rim 230 enclosing the inner rim 210, and a tire 240 fitted around the outer rim 230. The shaft 220 extends through a contact bearing 290 and is supported thereby for rotation, by means of which the wheel 200 is mounted to the chassis 110.

The front wheels 200A are freely rotatable about their bearings 290, which in turn are swivelable about respective vertical axes and are linked by an off-center cross bar 299 for synchronized wheel turning.

The rear wheel bearings 290 are fixed and axially aligned, with the associated shafts 220 in gear engagement with the drive unit 300 such that both rear wheels 200B are driven in tandem. The drive unit 300 includes an electric motor 310 connected by a pair of electrical wires 312 to the control circuit 400 for driving by the battery cell 410, a differential gear 320 driven by the motor 310, and left and right gearwheels 330 on opposite sides of the differential gear 320 in mesh with respective end gearwheels 250 of the two rear wheel shafts 220.

The toy car 10, whose basic construction has been described above, is preferably controlled by means of a wireless remote controller to run and move about. For this purpose, the control circuit 400 includes a receiver for receiving an RF control signal transmitted by the remote controller to control the motor 310. With regard to steering, the front wheels 200A may be turned to steer using an auxiliary motor or an electromagnetic actuator (magnet/coil arrangement) which is again operated by the control circuit 400.

Turning back to the wheels 200, each one is provided with an impact detector 500 for detecting an impact acted upon the wheel 200 by an opponent car. The detector 500 is formed by an electrical micro switch 510 that is normallyopen, a disc (or cap-like disc) 520 having a central shaft 530 extending rearwardly therefrom, and a compression coil spring 540.

The disc 520 is located partially in and extends across a front opening of the outer rim 230. Inside the combined rim 230/210, the spring 540 co-acts between the disc 520 and the inner rim 210 to thereby resiliently bias the disc 520 outwards. The shaft 530 extends co-axially through the wheel shaft 220, having a protruding rear end immediately behind which the switch 510 is located by a part (not shown) of the wheel bearing 290.

The switch 510 is connected to the control circuit 400 by a pair of electrical wires 512. The switch 510 includes a spring-loaded press button for closing, which is arranged to be depressed by the shaft 530 upon the disc 520 receiving an impact and hence pressed momentarily inwards against the action of the spring 540. Upon closing, the switch 510 provides a signal to the control circuit 400 for causing the circuit 400 to reduce the performance of the motor 310. The control circuit 400 is adapted to reduce the motor performance by either reducing the driving current to slow down the motor 310 and in turn the car 10 or by blocking the driving current to stop the motor 310 and hence the car 10.

Within the car housing 120 and covered by a respective transparent or translucent colored lens thereof, a lamp or LED 202 is situated close to each wheel 200. These LEDs 202 are connected to and controlled by the control circuit 400 for lighting up in response to the corresponding impact detectors 500 detecting impacts upon the corresponding wheels 200, thereby providing a visual indication that the relevant wheels 200 have been hit or "damaged".

Apart from the four impact detectors 500 associated with the wheels 200, there is a further impact detector 550 that is provided at the rear end of the chassis 110 of the car body 100. This detector 550 comprises another or a similar micro switch 560 and a bar 570 which is supported like a rear bumper for slight inward movement to, upon receiving an impact, momentarily press and close the switch 560. The switch 560 is likewise connected to the control circuit 400 by a pair of electrical wires 512 and, upon closing, provides a signal to the control circuit 400 for reducing the performance of the motor 310. Unlike the others, this detector 550 is not provided with any light for indicating a hit.

In this particular embodiment, there are five different specific positions or parts i.e. four wheels and the end, in the region of which the subject toy car 10 can be hit or stricken by another one, as sensed by the relevant detectors 500/550 or switches 510/560, to get "damaged". All those parts must be hit before the toy car 10 loses the game. Upon the first four hits, the relevant switches 510/560 will send corresponding signals to the control circuit 400 to progressively slow down the car 10, whereby maneuverability of the car 10 is hampered. The car 10 will finally stop when the remaining last part is hit.

Taking all the impact detectors 500/550 as a group, it is adapted to provide a number of signals upon successive impacts acted upon the car 10 for causing the control circuit 400 to progressively or gradually slow down the toy car 10 and eventually stop it. The positions or parts at which the toy car 10 may be attacked are in general not critical.

Figure 5:
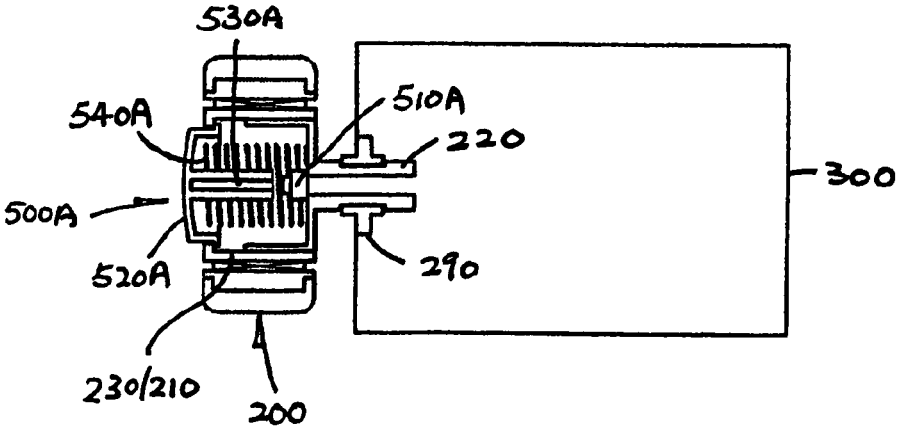
FIG. 5 is a cross-sectional view corresponding to FIG. 4A, showing an alternative construction of the wheel.

FIG. 5 shows an alternative impact detector 500A of a slightly different construction, with equivalent parts designated by the same reference numerals suffixed by a letter "A". In this detector 500A, the shaft 530A is shorter and does not extend through the wheel shaft 220, and the switch 510A is located inside the rim 230/210 right behind the shaft 530A.

It is envisaged that the subject moving toy may take up any other body designs, such as a spacecraft or tank.

The invention has been given by way of example only, and various other modifications of and/or alterations to the described embodiment may be made by persons skilled in the art without departing from the scope of the invention as specified in the appended claims.

What is claimed is:

1. A moving toy comprising:

a body;

rotary means for moving the body on a surface;

an electric motor provided in the body for driving the rotary means;

a control circuit connected to the motor for controlling the performance of the motor; and at least one impact detector connected to the control circuit for detecting an impact acted upon the toy and in response providing a signal to cause the control circuit to reduce the performance of the motor, including a plurality of said impact detectors provided at different positions of the toy, each for detecting an impact acted upon the toy in the region of the corresponding position, for providing corresponding signals causing the control circuit to progressively reduce the performance of the motor.

2. A moving toy comprising:

a body;

rotary means for moving the body on a surface;

an electric motor provided in the body for driving the rotary means;

a control circuit connected to the motor for controlling the performance of the motor; and at least one impact detector connected to the control circuit for detecting an impact acted upon the toy and in response providing a signal to cause the control circuit to reduce the performance of the motor, wherein said at least one impact detector is adapted to provide a plurality of said signals upon successive impacts acted upon the toy, the signals causing the control circuit to progressively reduce the performance of the motor.

3. The moving toy as claimed in claim 2, including a plurality of said impact detectors provided at different positions of the toy, each for detecting an impact acted upon the toy in the region of the corresponding position to provide a respective said signal.

4. A moving toy comprising:

a body;

rotary means for moving the body on a surface;

an electric motor provided in the body for driving the rotary means;

a control circuit connected to the motor for controlling the performance of the motor; and at least one impact detector connected to the control circuit for detecting an impact acted upon the toy and in response providing a signal to cause the control circuit to reduce the performance of the motor, wherein the rotary means comprise a plurality of wheels, and said at least one impact detector is provided at one of the wheels.

5. The moving toy as claimed in claim 4, wherein said at least one impact detector comprises an electrical switch associated with a receiver for receiving an impact, the receiver being located partially in the wheel and resiliently biassed outwards therefrom.

6. The moving toy as claimed in claim 5, wherein the receiver includes a shaft extending rearwardly therefrom and having a rear end immediately behind which the switch is located.

* * * * *